US005133240A

United States Patent [19]

Thiesen et al.

[11] Patent Number: 5,133,240

[45] Date of Patent: Jul. 28, 1992

[54] METHOD AND APPARATUS FOR PRODUCING LARGE-CALIBER AMMUNITION

[75] Inventors: Stefan Thiesen, Erkrath; Georg Klein, Meerbusch; Eckhard Rahnenführer, Dormagen, all of Fed. Rep. of Germany

[73] Assignee: Rheinmetall GmbH, Dusseldorf, Fed. Rep. of Germany

[21] Appl. No.: 618,565

[22] Filed: Nov. 27, 1990

[30] Foreign Application Priority Data

Nov. 28, 1989 [DE] Fed. Rep. of Germany ..... 3939295

[51] Int. Cl.[5] ..... F42B 3/00

[52] U.S. Cl. ..... 86/20.14; 86/29; 86/31; 102/431

[58] Field of Search ..... 86/20.11, 20.14, 23, 86/25, 29, 31, 10, 11, 12; 102/431, 432

[56] References Cited

U.S. PATENT DOCUMENTS

| | | | |
|---|---|---|---|
| 4,208,945 | 6/1980 | Davegardh et al. | 86/29 |
| 4,619,201 | 10/1986 | Romer et al. | 102/283 |
| 4,625,648 | 12/1986 | Klein et al. | 102/286 |
| 4,651,618 | 3/1987 | Ringel et al. | 86/20.14 |
| 4,668,465 | 8/1987 | Melhus et al. | 86/20.14 |
| 4,709,636 | 12/1987 | Mueller et al. | 102/431 |

*Primary Examiner*—J. W. Eldred

*Attorney, Agent, or Firm*—Spencer, Frank & Schneider

[57] ABSTRACT

A method and an apparatus for producing a large-caliber ammunition unit including a combustible or partially combustible propelling charge casing and compacted or partially compacted propelling charge powder, to increase internal ballistic performance. It is known to partially or completely compact or compress the propelling charge powder in a cartridge casing. However, such methods generally cannot be employed for ammunition including a combustible or at least partially combustible propelling charge casing because of the lower strength of the relatively thin-walled combustible casing material, as this would lead to deformation and/or to reduced loadability of such cartridges. The present invention permits the compaction or partial compaction of the propelling charge powder of an ammunition unit including a combustible propelling charge casing in that a pressing mold or matrix is employed which directly encloses the propelling charge casing, with an appropriate annular gap being left free between the inner surface of the propelling charge casing and the outer surface of the press die in dependence on the grain dimension of the propelling charge powder grains to be compacted so that the propelling charge powder can be compacted almost without shear forces with respect to the inner surface of the propelling charge casing.

11 Claims, 5 Drawing Sheets

FIG.3
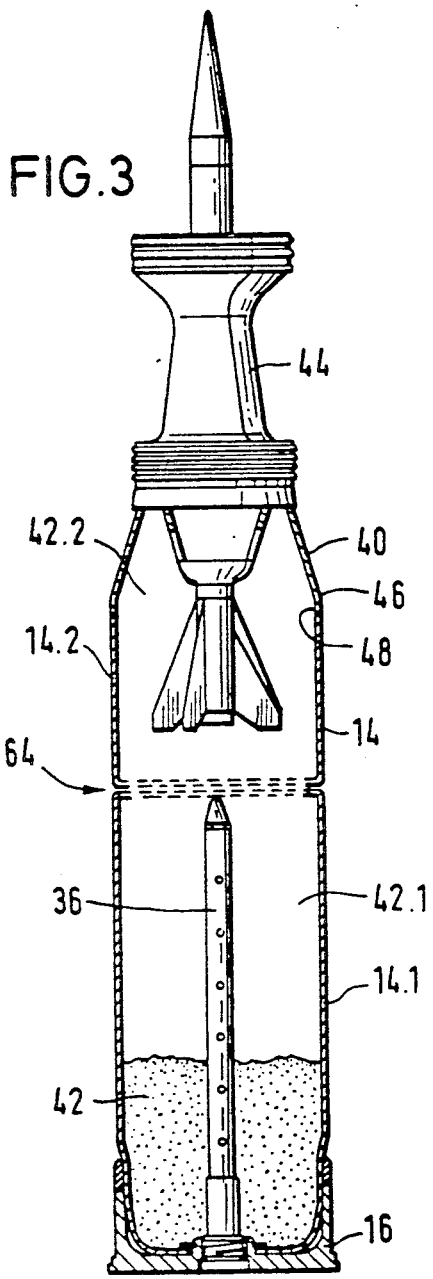
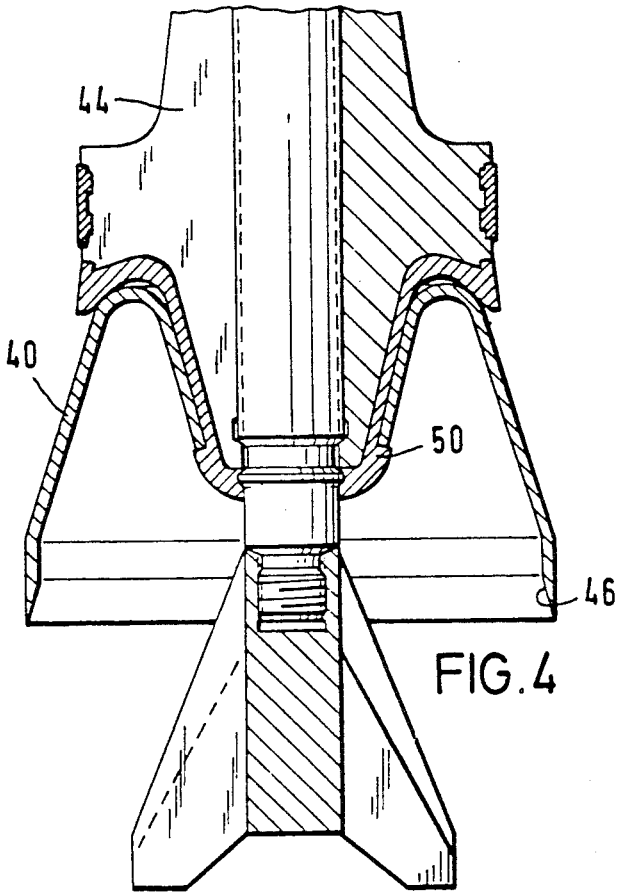
FIG.4
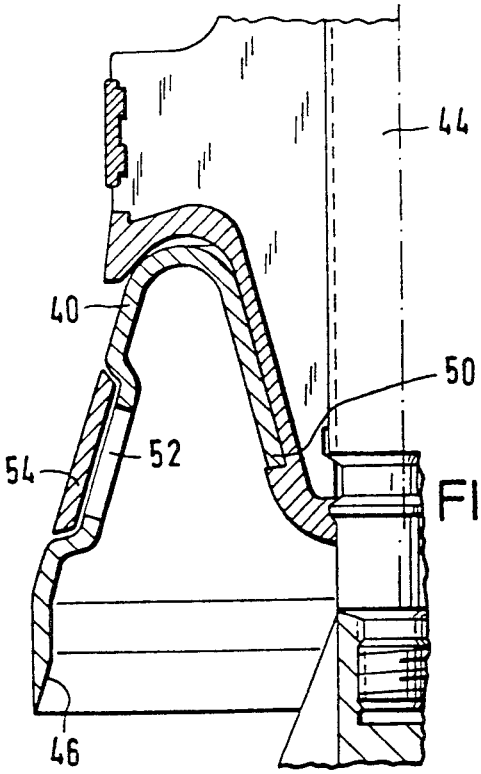
FIG.5

METHOD AND APPARATUS FOR PRODUCING LARGE-CALIBER AMMUNITION

REFERENCE TO RELATED APPLICATIONS

This application claims the priority of Federal Republic of Germany application Serial No. P 39 39 295.3 filed Nov. 28th, 1989, which is incorporated herein by reference.

BACKGROUND OF THE INVENTION

The present invention relates to a method and an apparatus for producing large-caliber ammunition including a combustible or partially combustible propelling charge casing and a compacted or partially compacted propelling charge powder. The present invention further relates to ammunition unit including a combustible or partially combustible propelling charge casing and a loose propelling charge which has been partially compacted according to the method of the invention.

Various methods are known in which, in order to increase the internal ballistic performance, the propelling charge powder is further compacted or compressed, either partially or completely, in a cartridge casing. The compaction or compression of the propelling charge powder is here always effected within a pressure resistant metal propelling charge casing or in some other, separate pressing device, with the compacted powder then being transferred into the propelling charge casing. It is here implicitly assumed that the material of the metal propelling charge casing or the other pressing device is suitable to withstand without deformation the radial pressure forces generated during the compaction or compression and acting perpendicular to the walls as well as the tangential friction forces (shear forces) acting parallel to its walls.

This is generally the case for propelling charge casings, projectile casings or other metal devices. For combustible or at least partially combustible propelling charge casings having, for example, non-combustible casing stubs or casing bottoms, the prior art propelling charge compaction methods cannot be employed due to the poor strength of the combustible material since the pressure forces perpendicular to the casing walls generated during the compaction or compression of the powder and the friction or shear forces also occurring during this process and acting parallel to the casing walls would destroy or at least deform the propelling charge casing to the extent that a cartridge stressed in such a way (enlargement of its diameter) could no longer be loaded into the weapon.

SUMMARY OF THE INVENTION

It is an object of the present invention, to employ the general method of compacting a propelling charge with reduction of the temperature gradient in the upper usable temperature range while simultaneously increasing the density of the charge as disclosed in EP-A 0,137,958 and corresponding U.S. Pat. No. 4,625,648, a method which in the past could be used only for pressure resistant metal propelling charge casings, also for propelling charge casings which are combustible or partially combustible and of poor strength.

The above object is generally achieved according to the method of the invention by a method of producing a cased propelling charge, including an at least partially combustible propelling charge casing containing at least partially compacted propelling charge powder, for a large-caliber ammunition unit, which method comprises the steps of: providing a propelling charge casing which is open at one end and has a base at its other end and which, in significant longitudinal regions, is composed of a thin-walled, combustible material having a comparatively low strength; inserting the casing into a press mold which surrounds the exterior of the propelling charge casing and directly supports the casing from the outside against internal radial compacting pressure; placing a quantity of propelling charge powder into the casing via its open end; compacting approximately 35% to approximately 80% of the propelling charge powder of the entire propelling charge for an ammunition unit by axially inserting a press die into the open end of the casing containing the propelling charge powder, with the press die having a diameter less than the inner diameter of the casing so as to leave an annular gap between an outer surface of the press die and an inner surface of the propelling charge casing, and with the annular gap being larger by a factor of 1.1 to about 3 than the grain dimension of a propelling charge grain of the propelling charge powder to be compacted so that the filled-in propelling charge grains are compressible essentially without shear forces relative to the inner surface of the propelling charge casing; and after compacting the portion of the propelling charge powder that is to be compacted. filling the casing with the residual, or remaining part, of the entire propelling charge powder and covering the open end of the casing.

The combustible propelling charge casing here lies against the interior of a hollow metal cylinder (pressing matrix). This avoids widening of the casing due to the radial pressure forces generated during the pressing process. Moreover, according to the present invention, the diameter of the press die is smaller by more than twice the dimensions of the powder grains than the inner diameter of the combustible casing. This measure prevents the transfer of great friction/shear forces to the combustible propelling charge casing since the powder grains are able to move relatively freely during the pressing process in the existing annular gap between the press die and the inner wall of the casing and are unable to simultaneously contact the outer wall of the press die and the inner wall of the propelling charge casing.

A prerequisite for the compaction of propelling charge powder in a combustible or at least partially combustible propelling charge casing is that the powder grains have sufficient ductility, which is generally the case to a sufficient extent for multi-base propelling charge powders, since it must be impossible for the powder grains to damage the casing material during the compaction process.

According to the present invention, the combustible propelling charge casing is held during the pressing process by an external metal support (pressing matrix or mold) in order to prevent radial widening of the casing and not to adversely influence its loadability. Moreover, the size of the free space between the exterior or circumferential surface of the press die and the interior wall of the propelling charge casing is of great significance for compaction within the combustible propelling charge casing. It has been found that even under the condition that the press die and the propelling charge casing do not contact one another during the compacting process, methods in which the resulting free annular space between the die and the casing is too small are not suitable for combustible casings because the powder grains then transfer very great shear forces to the propelling charge casing. The free annular space between the exterior of the die and the interior wall of the combustible propelling charge casing must therefore correspond to the grain dimensions of the propelling charge powder and must be somewhat larger than the powder grains (factor about 1.1 to 3).

During the compaction process, the propelling charge igniter may be replaced by an inserted mandrel (blind piece), which, during final assembly, is exchanged for the propelling charge igniter. However, the compaction process may also be performed with the propelling charge igniter installed completely. In that case, the top of the propelling charge igniter should be protected by a cap which, if required, must be extended to ensure guidance of the press die which has a central bore. The mandrel-like cap is removed after the compaction process.

The compaction of the propelling charge portion to be compacted, about 35% to about 80% of the entire propelling charge, may take place in one pressing phase. However, if the combustible propelling charge casing is long, particularly for large-caliber ammunition of 120 mm or, for example, 140 mm, it may also be necessary or advisable to compact the propelling charge component in several steps, with only a small quantity of propelling charge powder being compacted in the first step and additional propelling charge powder being filled into the casing before each subsequent compaction step.

In both types of compaction, a portion of about 65% to about 20% of loosely poured-in propelling charge powder is filled in after the last compaction to remain uncompacted at the upper end of the propelling charge casing or, more precisely, at the end of the propelling charge casing near the projectile.

The present invention will now be described and explained below in greater detail with reference to embodiments thereof that are illustrated in the drawing figures.

BRIEF DESCRIPTION OF THE DRAWINGS

FIG. 3 is a schematic partial longitudinal sectional view of one embodiment of an ammunition unit according to the invention.

FIG. 4 is an enlarged detail view of a portion of the ammunition unit of FIG. 3 showing the tail section of the projectile with its forward propelling charge casing cover.

FIG. 5 is a further enlarged partial view of FIG. 4 showing the region of the propelling charge casing cover.

DETAILED DESCRIPTION OF THE PREFERRED EMBODIMENTS

Figure 1:
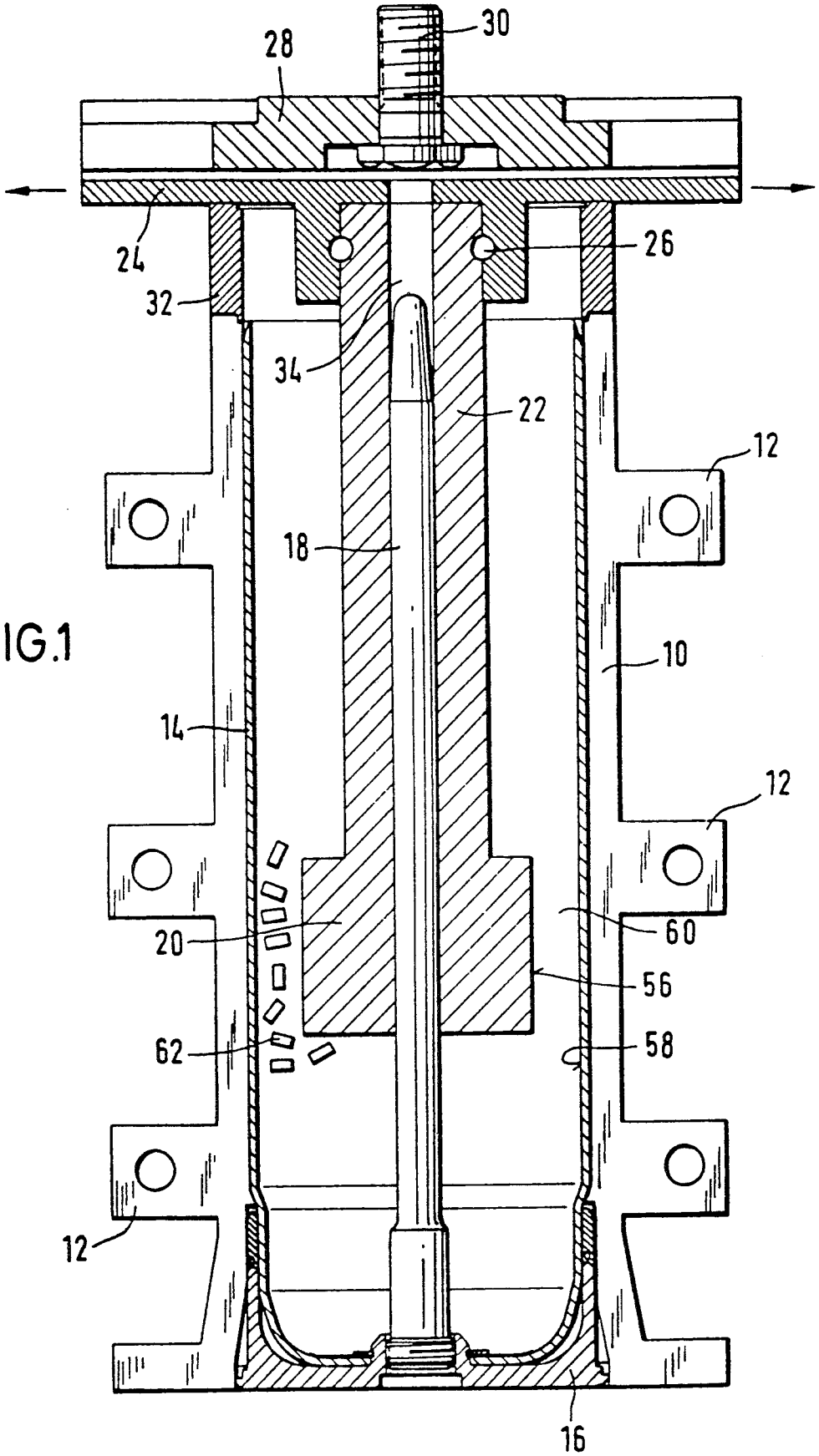
FIG. 1 is a schematic cross-sectional view of an apparatus according to the invention for carrying out the method according to the invention for compacting a poured-in propelling charge powder.

In FIG. 1, the reference numeral 10 identifies a press mold or pressing matrix composed of two half shells (only one of which is seen in the figure) and forming a cylindrical interior chamber into which a cylindrical combustible propelling charge casing 14 having a non-combustible casing bottom 16 (casing stump) has been inserted. The chamber formed in the press mold 10 has an inner diameter which corresponds to the outer diameter of the casing 14 so that the casing is radially supported along its length. The two half shells of press mold 10 are held together by means of three annular clamping flanges 12 provided on the outer circumference of press mold 10 and are fixed to one another so as to be quickly releasable, for example, for insertion and removal of a propelling charge casing 14.

A long mandrel 18 is arranged centrally in propelling charge casing 14. The mandrel 18 is screwed into a control opening in the casing bottom 16 instead of an ignition tube and is exchanged after the pressing process for a conventional primer or ignition tube which is susceptible to transverse forces. A longitudinally displaceable press die 20 including a press die shaft 22 is inserted from the top into the open end of propelling charge casing 14. Press die 20 and press die shaft 22 are provided with a throughgoing central bore 34 which serves to accommodate mandrel 18 or a propelling charge ignition tube 36, respectively.

Press die shaft 22 is fastened in a die holder 24 by means of two fixing pins 26. Die holder 24 is fastened to a head piece 28 so as to be horizontally displaceable, for example, by way of interleaving double-T rails or dovetail groove rails so as to laterally align press die 20. Head piece 28 is screwed, by way of a fastening screw 30, to a longitudinally displaceable hydraulic cylinder (not shown) of a pressing machine.

Pressing matrix 10 has approximately the same length as the inserted combustible propelling charge casing 14. At the upper edge of pressing matrix 10, there is attached an exchangeable spacer ring 32 which, depending on its height and insertion depth, serves as a fixed abutment for press die 20 (more precisely, press die receptacle 24). Thus, the degree of compaction of the propelling charge and the immersion depth of press die 20 can be predetermined in the various pressing steps by way of different spacer rings 32.

Figure 2:
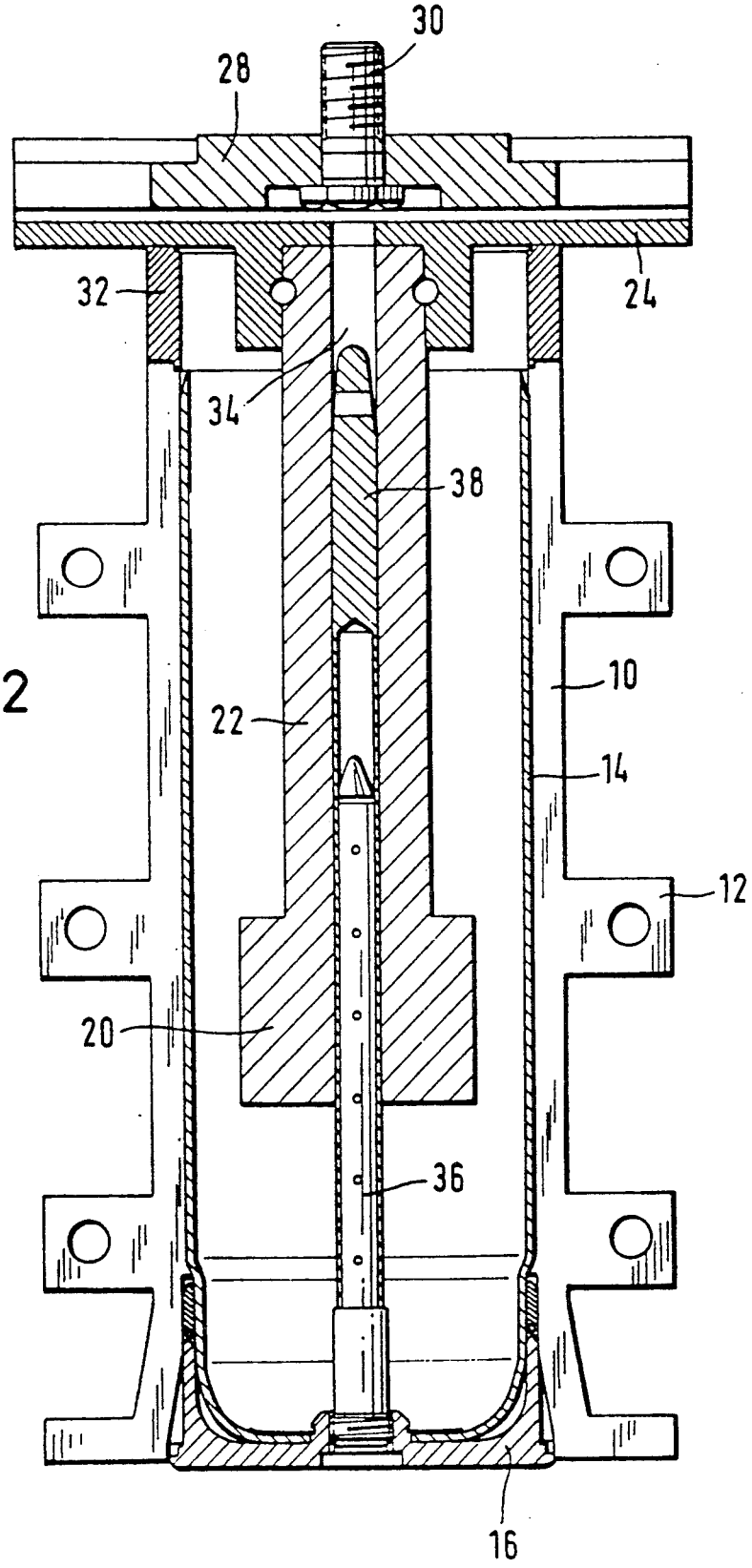
FIG. 2 is a schematic cross-sectional view of the apparatus according to the invention for a modified compaction method according to the invention.

In FIG. 2, the actual ignition tube 36 (primer) has already been screwed into casing bottom 16 instead of a blind mandrel before the pressing process starts. As protection and for guidance (centering) of the press die, a sleeve-shaped protective cap 38 is placed onto the top of ignition tube 36.

To clearly illustrate the order of magnitude of the propelling charge grain dimensions and the annular gap 60 between the outer wall 56 of press die 20 and the inner wall 58 of propelling charge casing 14, several propelling charge grains 62 are shown in the annular gap 60 of FIG. 1.

Thus, the ratio of the annular gap 60 to the respective grain dimensions is quite significant for the present invention in order to realize compaction of loose powder within a combustible or partially combustible propelling charge casing without the destructive effect of shear forces on the casing. The ratio of annular gap 60 to the respective grain dimensions should lie between about 1.1 and 3, preferably at about 1.8.

FIG. 3 shows an ammunition unit in which a propelling cage sabot projectile arrangement 44 is disposed at the front. Any desired full-caliber or subcaliber projectile with a propelling cage may be employed. The combustible propelling charge casing 14 includes a non-combustible, for example, metal casing stub or base 16 at its bottom in which the ignition tube 36 (primer) has been centrally screwed in. Propelling charge casing 14 is cylindrical in its essential length regions and is provided at the front with a propelling charge casing cover 40 which, in a known manner, is connected with projectile arrangement 44 by way of a snap connection 50 (see FIG. 4) and which, during or after assembly, is connected, that is, for example glued, to the cylindrical portion of propelling charge casing 14 in an appropriately sloped fastening region 46, 48.

Propelling charge powder 42 has been compacted in the lower region of propelling charge casing 14 around the entire ignition tube 36 and over its entire length, while the remaining propelling charge powder in the upper region of propelling charge casing 14 has merely been poured loosely onto the compacted portion.

To assemble the one-piece ammunition unit, the propelling charge powder 42 is initially compacted in the pressing device (shown in FIGS. 1 and 2) directly in the cylindrical portion of propelling charge casing 14. Then, the propelling charge casing cover 40 shown in FIG. 4 together with the inserted projectile arrangement 44 is placed onto the cylindrical part of propelling charge casing 14 and is fastened, that is glued on. For this purpose, the fastening region 46 (lower edge) of casing cover 40 and fastening region 48 (upper edge) of the cylindrical propelling charge casing 14 are each provided with the appropriate slope as shown for the edge 46 in FIG. 4.

When the one-piece ammunition unit has been completed in its outer dimensions, the remainder of the propelling charge powder is poured loosely in as the last step. For this purpose, casing cover 40, as can be seen in FIG. 5, has a fill opening 52 (recess/window) on its side which, after the loose propelling charge powder has been poured in, is closed by means of an inserted and glued-in closing disc 54 and is sealed. Casing cover 40 and closing disc 54 may here also be manufactured, for example, of combustible material.

One further particular feature of the invention is shown in FIG. 3. A central contact region 64 for a rear ammunition part 14.1 and a forward ammunition part 14.2 are shown in dashed lines approximately in the middle of the ammunition unit. In this two-piece ammunition unit, for example, the forward part of the ammunition unit, i.e., front casing portion 14.2, cover 40, projectile 44 and powder portion 42.2, may be exchangeable and the same rear drive portion, i.e., rear casing portion 14.1, base 16 with ignition tube 11, and rear powder portion 42.1, may be combined and fired, depending on the intended purpose, with appropriate projectiles (e.g. explosive projectile, kinetic energy projectile, shaped charge projectile) in the forward part of the ammunition unit.

In this embodiment, only the rear portion 42.1 of the loose propelling charge powder in the rear part 14.1 of the casing 14.1 is compacted in the apparatus shown in FIGS. 1 and 2, while the portion 42.2 of propelling charge powder in the front part 14.2 of the casing incorporating projectile arrangement 44 is merely poured in loosely.

The assembly (and compaction) of the portion of the propelling charge powder in the combustible propelling charge casing here advisably starts in the central contact region 64. After compaction of propelling charge powder portion 42.1 in the rear (lower) part 14.1 of the ammunition unit, the last pressed-in free volume (last path of the pressed-in press die) can be filled with loose powder to the upper edge or end, and this open end of ammunition part 14.1 is then closed by means of a combustible covering disc that is, for example, glued on.

The procedure for the forward ammunition or casing part 14.2 is corresponding. Ammunition or casing part 14.2 is here placed in such a manner that central contact region 64 is oriented upwardly and projectile arrangement 44 is oriented downwardly. Then the portion of propelling charge powder 42.2 is loosely poured in up to the edges and ammunition or casing part 14.2 is likewise closed and sealed in its central contact region 64 by means of a, for example, glued-on combustible covering disc.

This two-part ammunition unit is more easily handled by the soldier at the weapon (lower individual weight) and has logistic advantages.

Figure 6:
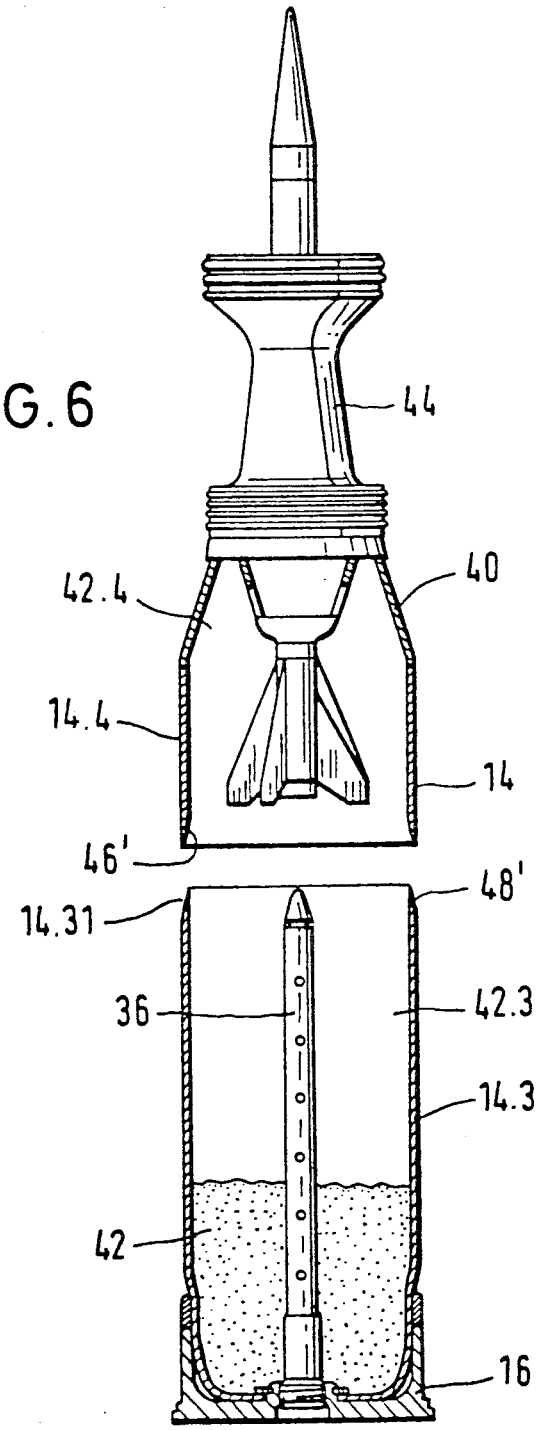
FIG. 6 is a schematic partial longitudinal sectional view of a further embodiment of an ammunition unit according to the invention.

FIG. 6 shows still a further embodiment of the present invention in which two propelling charge casing parts are combined into a one-piece ammunition unit. Propelling charge casing 14 is composed of a rearward, combustible propelling charge part 14.3 whose bottom is disposed in a non-combustible casing stub 16 into which the ignition tube 36 has been centrally screwed. A forward propelling charge casing part 14.4 includes a casing cover 40 which is fastened to projectile 44 and to the cylindrical portion of propelling charge casing 14 as shown in FIGS. 3 and 4. However, in the embodiment of FIG. 6, propelling charge casing cover 40 may also be connected in one piece with propelling charge casing part 14.4 so that the sloped fastening regions 46, 48 according to FIGS. 3, 4 and 5 are not required.

To assemble the ammunition unit, propelling charge powder portion 42.3 is filled into the rear propelling charge casing part 14.3 and is compacted within the pressing device (shown in FIGS. 1, 2), with the compaction of propelling charge powder 42.3 preferably being effected up to the upper edge 14.31 of rear propelling charge casing part 14.3. To fill the forward propelling charge casing part 14.4 with propelling charge powder portion 42.4, the forward propelling charge casing part 14.4, once projectile arrangement 44 has been attached, is set up in such a manner that projectile arrangement 44 is oriented downwardly. Propelling charge powder portion 42.4 is poured in loosely up to the edge and rear propelling charge casing part 14.3 is placed from the top onto the forward casing part 14.4 and connected with it. To establish a connection between the two casing parts 14.3 and 14.4, both parts are provided with sloped fastening edges 46' and 48', respectively, which are glued together.

Depending on the selected pressure for compaction of propelling charge powder portion 42.3 in rear propelling charge casing part 14.3, the latter may additionally be provided at its upper edge 14.31 with a thin, combustible sheet (not shown) so as to prevent compacted propelling charge powder 42.3 from being released from the surface when the component is placed onto forward propelling charge casing part 14.4.

The lateral opening 52 shown in FIG. 5 in casing cover 40 for filling in loose propelling charge powder 42, which is closed by means of a closure disc 54 after filling, is not required (but may be provided) in the assembly of a one-piece ammunition unit according to the embodiment of FIG. 6.

The propelling charge powder 42.4 filled into the forward propelling charge casing part 14.4 may also be compacted before the rear casing part 14.3 is connected. The compaction in this casing part 14.4 here preferably takes place in such a way that, in the vicinity of projectile 44, the propelling charge powder 42.4 has a density which approximately corresponds to that of loosely poured propelling charge powder or is only slightly higher.

Such a compaction of propelling charge powder in the forward part of the ammunition unit is also possible in the arrangement according to FIG. 3. The portion of propelling charge powder 42.2 here filled into the frontal portion 14 2 of the ammunition unit is likewise compacted before ammunition part 14.2 is closed and sealed, for final assembly, with a combustible covering disc in central contact region 64.

Figure 7:
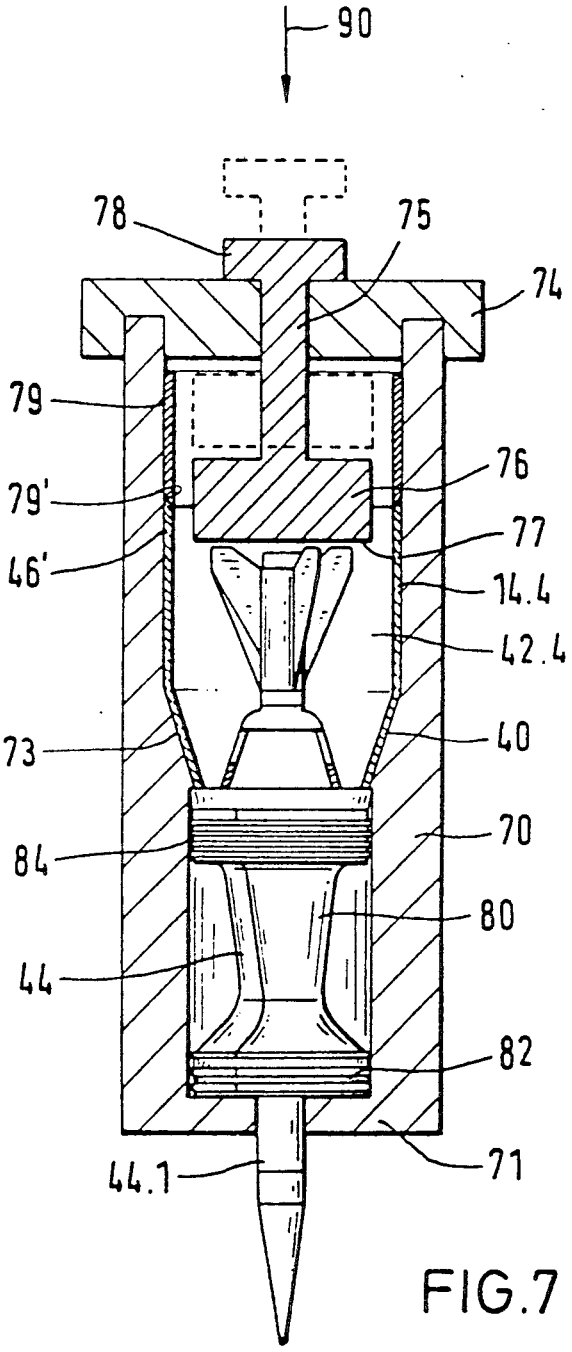
FIG. 7 is a schematic cross-sectional view of an apparatus for carrying out the method according to the invention for compacting a poured-in propelling charge powder in a forward propelling charge casing part according to FIG. 6.

FIG. 7 schematically shows an apparatus for compacting powder in the forward charge casing part 14.4.

In FIG. 7, the reference numeral 70 identifies a press mold having an interior chamber into which the forward propelling charge casing part 14.4 which is fastened to the projectile 44 has been inserted. Press mold 70 is provided with the bottom 71 having a central bore which serves to accommodate a forward portion 44.1 of the projectile 44.

Projectile 44 is mounted in a dual flange sabot 80, whose forward flange 82 is supported by the bottom 71 of press mold 70. In the region of the sabot 80 between its forward flange 82 and a rear pressure flange 84, the inner diameter of the press mold 70 corresponds to the outer diameter of the sabot flanges 82, 84, but increases towards the direction of the forward propelling charge casing part 14.4, showing a conical transition region 73 adjacent to the propelling charge casing cover 40, which may be connected in one piece with propelling charge casing part 14.4. During the compaction process, the conical transition 73 in the inner diameter of the press mold 70 supports the propelling charge casing cover 40, which may be manufactured of combustible material.

The length of the press mold 70 extends upwardly beyond the edge 46' of the propelling charge casing part 14.4. To protect this sloped fastening edge 46' during the compaction, a ring 79, of the same thickness as the propelling charge casing part 14.4 and with a corresponding sloped edge 79', is positioned in press mold 70 above the casing part 14.4.

The upper end of the press mold 70 is provided with a die holder 74 having a central axial bore to accommodate the press die shaft 75. Press die shaft 75 is formed in one piece with a press die 76 and is longitudinally displaceable for compaction of the propelling charge 42.4. According to FIGS. 1 and 2, the ratio of the annular gap between the outer wall of the press die 76 and the inner wall of the propelling charge casing 14.4 to the respective grain dimensions should lie between about 1.1 and 3, preferably at about 1.8.

Propelling charge powder 42.4 is compacted by moving the press die shaft 75 in one step axially downwards in the direction of arrow 90. The press die 76 thus moves from a position indicated in dashed lines to its final position, where its surface 77 reaches the sloped fastening edge 46' of the forward propelling charge casing part 14.4. The movement of the press die 76 and the press die shaft 75 is limited in its final position by a head piece 78 of press die shaft 75 contacting the outer surface of the die holder 74.

Out of this one step compaction process a density gradient results in the propelling charge powder 42.4. The density is greatest in the region where the press die 76 directly contacts the propelling charge powder 42.4, that is in the region of the edge 46' of the casing part 14.4, and decreases towards the vicinity of projectile 44. Under a low pressure force acting on the press die 76, the density drops down to a value that corresponds to that of the loosely poured-in propelling charge powder or is only slightly higher.

The invention now being fully described, it will be apparent to one of ordinary skill in the art that any changes and modifications can be made thereto without departing from the spirit or scope of the invention as set forth herein.

What is claimed is:

1. A method of producing a cased propelling charge, including an at least partially combustible propelling charge casing containing at least partially compacted propelling charge powder, for a large-caliber ammunition unit, comprising the steps of:

providing a propelling charge casing which is open at one end and has a base at its other end and which, in significant longitudinal regions, is composed of a thin-walled, combustible material having a comparatively low strength;

inserting the casing into a press mold which surrounds the exterior of the propelling charge casing and directly supports the casing from the outside against internal radial compacting pressure;

placing a quantity of propelling charge powder into the casing via its open end;

compacting approximately 35% to approximately 80% of the propelling charge powder of the entire propelling charge for an ammunition unit by axially inserting a press die into the open end of the casing containing the propelling charge powder, with the press die having a diameter less than the inner diameter of the casing so as to leave an annular gap between an outer surface of the press die and an inner surface of the propelling charge casing, with the annular gap being larger by a factor of 1.1 to about 3 than the grain dimension of a propelling charge grain of the propelling charge powder to be compacted so that the filled-in propelling charge grains are compressible essentially without shear forces relative to the inner surface of the propelling charge casing; and after compacting the portion of the propelling charge powder that is to be compacted, filling the casing with the residual of the entire propelling charge powder and covering said open end of the casing.

2. A method as defined in claim 1 wherein the annular gap is larger by a factor of 1.8 than the grain dimension of the propelling charge grain of the propelling charge powder to be compacted.

3. A method as defined in claim 1 wherein said steps of placing and compacting are carried out a number of times in succession.

4. A method as defined in claim 1 wherein said step of covering includes attaching a projectile to the open end of said casing.

5. A method as defined in claim 1 wherein the propelling charge includes an ignition tube extending from the base along the longitudinal axis of the casing, and said die has a central axial bore to accommodate the ignition tube; and wherein said method further comprises: prior to said step of placing a quantity of propelling charge powder, inserting an ignition tube into the propelling charge casing via a central opening in said casing base; and, during said step of compacting, compacting the propelling charge powder around the ignition tube by means of the press die provided with a central axial bore to accommodate the ignition tube.

6. A method as defined in claim 1 wherein the propelling charge includes an ignition tube extending from the base along the longitudinal axis of the casing, and said die has a central axial bore of a length to accommodate the ignition tube; and wherein said method further comprises prior to said step of placing a quantity of propelling charge powder, inserting a central mandrel into the propelling charge casing via a central opening in said casing base; during said step of compacting, compacting the propelling charge powder around the mandrel; and after said step of compacting, extracting the mandrel from the casing having the compacted propelling charge powder, and inserting the ignition tube into the center of the propelling charge via the opening in the casing base.

7. A method as defined in claim 1 further comprising providing a projectile having a cover, formed of combustible material, for said casing attached to and surrounding a tail section of the projectile; and wherein: said step of covering includes attaching said cover to said open end of said casing such that said tail section is inserted into the propelling charge casing; and said step of filling takes place after said step of attaching and includes loosely pouring the remaining propelling charge powder into the closed casing through a laterally disposed fill opening in said cover and thereafter closing the fill opening.

8. A method as defined in claim 1 wherein the cased propelling charge for the ammunition unit is composed of first and second separate parts including a first rear part produced according to the method of claim 1 and a second front part including a further casing part formed of said thin walled combustible material and having a cylindrical portion of the same diameter as said first part and a front cover portion which closes one end of said cylindrical portion and which is attached to and surrounds a tail section of a projectile which extends into said cylindrical portion; and wherein said method further comprises: loosely pouring the remainder of the propelling charge powder for the propellant charge into said further casing part; and applying a cover to the other end of said cylindrical portion of said further casing part.

9. A method as defined in claim 8 further comprising: prior to said step of applying a cover, compacting the propelling charge powder in said further casing part, with the compaction process being such that the density gradient produced during the compaction leads to a density in the vicinity of the tail section of the projectile disposed in said further casing part which, at most, is only slightly higher than the density of the loosely poured-in propelling charge powder.

10. A method as defined in claim 1 wherein the propelling charge casing for the ammunition unit is composed of first and second parts including a first rear part formed according to the method of claim 1 and a second front part formed of said thin walled combustible material and having a cylindrical portion of the same diameter as said first rear part and a front portion for connection to a tail section of a projectile; and wherein said method further comprises:

inserting the tail section of the projectile into said front portion of said casing so that said tail section of the projectile extends into said cylindrical portion of said front part of said casing, and connecting the front portion of said casing to the projectile;

orienting said second part of said casing so that said projectile is facing downward;

loosely pouring the remaining propelling charge powder into said second part of said casing; and, carrying out said step of closing by connecting the open end of said first part of said casing to the open end of said second part of said casing to form a one piece propelling charge casing.

11. A method as defined in claim 10 further comprising: prior to said step of connecting the open end of said first part, compacting the propelling charge powder in said further casing part, with the compaction process being such that the density gradient produced during the compaction leads to a density in the vicinity of the tail section of the projectile disposed in said second casing part which, at most, is only slightly higher than that of loosely poured-in propelling charge powder.

* * * * *